US010154335B1

(12) United States Patent
Hoang

(10) Patent No.: US 10,154,335 B1
(45) Date of Patent: Dec. 11, 2018

(54) INTERCHANGEABLE SPEAKER ASSEMBLY AND METHOD OF USE

(71) Applicant: Minh Dung Hoang, Edison, NJ (US)

(72) Inventor: Minh Dung Hoang, Edison, NJ (US)

( * ) Notice: Subject to any disclaimer, the term of this patent is extended or adjusted under 35 U.S.C. 154(b) by 164 days.

(21) Appl. No.: 15/257,033

(22) Filed: Sep. 6, 2016

(51) Int. Cl.
*H04R 1/10* (2006.01)

(52) U.S. Cl.
CPC ..... *H04R 1/1075* (2013.01); *H04R 1/105* (2013.01); *H04R 1/1008* (2013.01)

(58) Field of Classification Search
CPC ..... H04R 1/1075
See application file for complete search history.

(56) References Cited

U.S. PATENT DOCUMENTS 2,235,372 A * 3/1941 Kalbitz ..... H04R 1/1066 381/371
3,798,393 A * 3/1974 Gorike ..... H04R 1/1008 381/347
5,729,605 A * 3/1998 Bobisuthi ..... H04R 1/1041 379/430
7,519,196 B2 * 4/2009 Bech ..... H04R 1/105 381/370
8,311,257 B2 * 11/2012 Hu ..... H04R 1/1066 381/301
8,503,970 B1 * 8/2013 Uyehara ..... H04M 1/0262 379/428.01
8,515,103 B2 * 8/2013 Mei ..... H04R 1/1016 381/309
8,542,859 B2 9/2013 Alden
9,226,060 B2 12/2015 Minarik et al.
2006/0104471 A1 5/2006 Tsunoda et al.
2008/0044003 A1 * 2/2008 Yang ..... H04R 1/1016 379/430
2008/0279409 A1 * 11/2008 Hupkes ..... H04R 1/1066 381/370
2009/0169041 A1 * 7/2009 Zurek ..... H04M 1/035 381/345
2009/0323975 A1 * 12/2009 Groesch ..... H04R 1/1091 381/71.1
2010/0321899 A1 * 12/2010 Vossoughi ..... B60R 11/02 361/728
2011/0249855 A1 * 10/2011 Tamura ..... H04R 1/1016 381/380
2013/0177195 A1 * 7/2013 Sze ..... H04R 1/1033 381/384
2013/0343563 A1 * 12/2013 Reiser ..... H04R 1/1091 381/74
2014/0016795 A1 1/2014 Melamed
(Continued)

FOREIGN PATENT DOCUMENTS

EP 2779687 9/2014
WO WO2010068495 6/2010

*Primary Examiner* — Matthew A Eason
*Assistant Examiner* — Taunya McCarty
(74) *Attorney, Agent, or Firm* — Goldstein Law Offices, P.C.

(57) ABSTRACT

An interchangeable speaker assembly for use in a headphone adapted to receive the interchangeable speaker assembly. Multiple interchangeable speakers assemblies are intended for use with the headphones, each with a unique audio profile. By substituting interchangeable speaker assemblies, a user is capable of customizing the sound characteristics of the set of headphones, and altering the user's listening experience.

18 Claims, 8 Drawing Sheets

(56) References Cited

U.S. PATENT DOCUMENTS

| | | | | |
|---|---|---|---|---|
| 2014/0270228 | A1 | 9/2014 | Oishi et al. | |
| 2015/0237424 | A1* | 8/2015 | Wilker | H04R 1/026 381/150 |
| 2016/0080853 | A1* | 3/2016 | Chen | H04R 1/1041 381/74 |
| 2016/0182990 | A1* | 6/2016 | Yamamoto | H04R 1/10 381/379 |

* cited by examiner

INTERCHANGEABLE SPEAKER ASSEMBLY AND METHOD OF USE

TECHNICAL FIELD

The present disclosure relates generally to an interchangeable speaker assembly and its method of use. More particularly, the present disclosure relates to a series of interchangeable speaker assemblies that can be easily switched out by a user to provide the user with a customizable listening experience, each of the interchangeable speaker assemblies having a specific and unique audio profile.

BACKGROUND

Since their invention in 1910, headphones have grown immensely in their popularity. While the initial headphones were crude inventions that had poor sound quality and caused the user great discomfort, large strides have been made to improve both of these problems. In fact, due to improvements in manufacturing techniques and to the design of speakers, it has become cheaper and easier than ever to create headphones with high quality sound that can be worn comfortably for extended periods of time.

With this increased ease in manufacturing, an incredibly large amount of different headphones are manufactured, some to provide a particular audio profile, some to provide comfort based on user preference, or to achieve some other objective. Regardless of the motivations, there exists a panoply of headphones available for purchase today. However, with this large amount of specialized headphones available, users who want a dynamic, customizable listening experience are forced to purchase a number of different headphones to achieve this feat. For example, a user may want one set of headphones to listen to classical music while doing work, but then will use a separate set of headphones for the gym, ones that are optimized for hard rock and other high-energy music. There are many other examples where a user desires different audio characteristics at different times. As such, there exists a need for a set of headphones that is capable of providing different audio profiles in a single integrated system.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a means for quickly customizing the sound characteristics of a set of headphones on the fly. Accordingly, the present disclosure provides for an interchangeable speaker assembly having a unique audio profile, where the interchangeable speaker assembly may be substituted out for an alternative interchangeable speaker assembly having an alternative unique audio profile.

Accordingly, the present disclosure describes an interchangeable speaker assembly for use with a set of headphones. The set of headphones is equipped with at least one receiver having a front area and a back area, where the back area includes a cavity. This cavity has a rear opening for receiving the interchangeable speaker assembly, a front opening for providing sound from the interchangeable speaker assembly to a user, and a sidewall that extends between the front opening and the back opening. The sidewall is shaped to accommodate the interchangeable speaker assembly and includes a first electrical connector and at least one female attachment mechanism. Each interchangeable speaker assembly includes a speaker module, an acoustical chamber shell, and an acoustical chamber defined therebetween. The speaker module includes a speaker housing and an audio driver, and the speaker housing has a front end, a rear end, a wall that extends between said front end and said rear end, and a flange connected to the rear end. The front end has a smaller circumference than the rear end. The wall has an interior surface, an exterior surface which includes at least one male attachment mechanism and a second electrical connector which corresponds to the first electrical connector. There is also an acoustical chamber shell which has a circular main portion and a downwardly extending lip. The acoustical chamber shell is mated to the flange of the speaker housing. The interchangeable speaker assembly also has an acoustical chamber which is bounded by the rear end of the speaker module and the main portion of the acoustical chamber shell. Various combinations of male attachment mechanisms and female attachment mechanisms are contemplated by the present disclosure.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
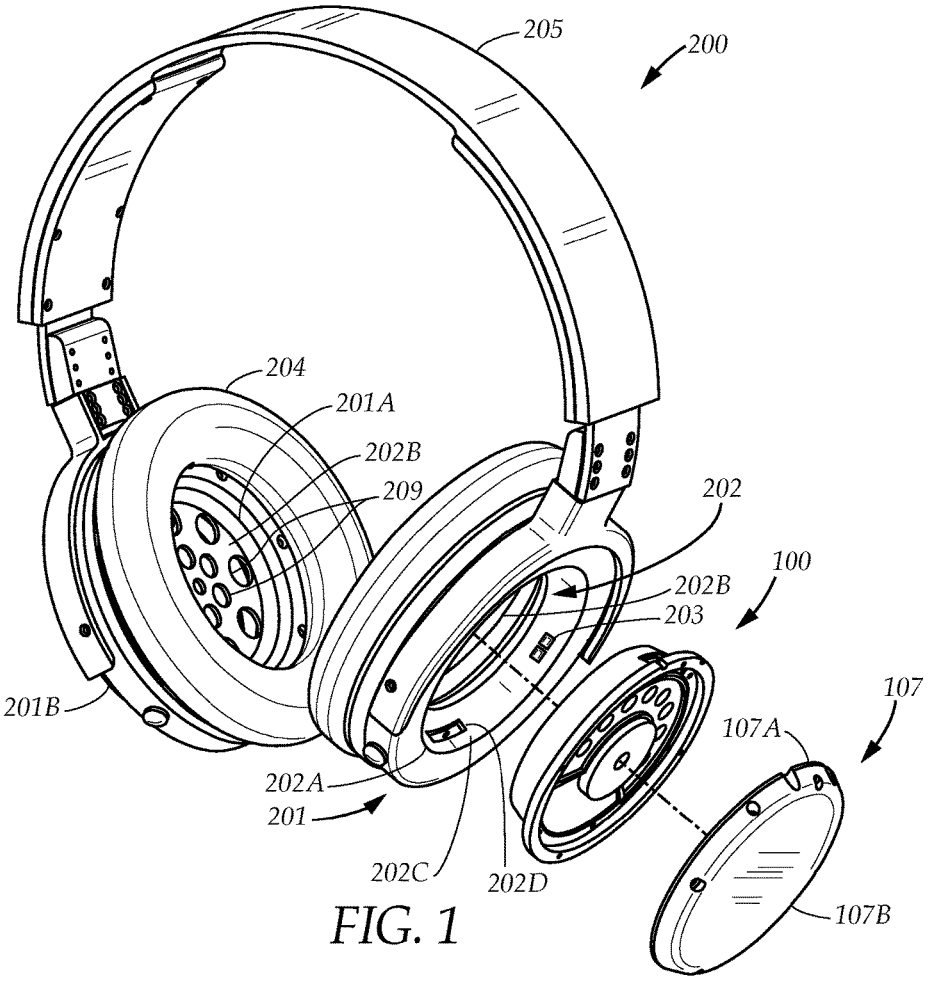
FIG. 1 is a diagrammatic perspective view of an example embodiment of a set of headphones with an integrated interchangeable speaker apparatus according to the present disclosure.
Figure 1A:
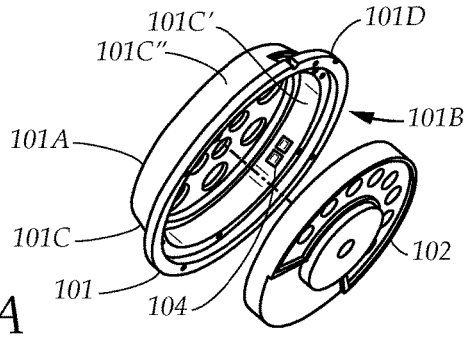
FIG. 1A is a diagrammatic perspective view of an example embodiment of a speaker module according to the present disclosure.

FIG. 1 illustrates an interchangeable speaker assembly for use in a set of headphones 200 including a speaker module 100 and an acoustical chamber shell 107. Referring momentarily to FIG. 1A, the speaker module 100 includes a speaker housing 101 and an audio driver 102. The speaker housing 101 which has a front end 101A, a rear end 101B, a wall 101C which extends between the front end 101A and the rear end 101B, and a flange 101D which is connected to the rear end 101B. Preferably, the front end 101A will have a smaller circumference than the rear end 101B. The wall 101C has an interior surface 101C' and an exterior surface 101C". The speaker housing 101 has a second electrical connector 104 which extends through the wall 101C, and is thereby accessible at the exterior surface 101C", and also at the interior surface 101C' (best seen in FIG. 1A). In some embodiments, the exterior surface 101C" has at least one male attachment mechanism 103 (See FIG. 4A). Referring to both FIG. 1 and FIG. 1A, the acoustical chamber shell 107 is selectively attached to the flange 101D. In particular, the acoustical chamber shell 107 has a front edge 107A and a rear edge 107B. The front edge 107A of the acoustical chamber shell 107 is selectively attachable to the flange 101D. As shown in FIG. 1A, the audio driver 102 fits within the speaker housing 101 and when inserted into the speaker housing 101 is in electronic communication with the second electrical connector 104. In ordinary usage, the speaker housing remains intact, with the audio driver 102 remaining attached within the speaker housing 101.

The set of headphones 200 includes at least one receiver 201 and generally includes a left end and a right end which each have one of the receivers 201, an earpad 204 at each receiver, and a headband 205 that connects the receivers 201. The at least one receiver has a front area 201A, a back area 201B, and includes a cavity 202 extending forwardly from the back area 201B. The cavity 202 has a rear opening 202A, a sound permeable front wall 202B, a sidewall 202C which extends between the rear opening 202A and the front wall 202B, a first electrical connector 203 disposed on the sidewall 202C, and at least one female attachment mechanism 202D is also disposed on the sidewall 202C. The cavity 202 is sized to receive the speaker module 100, and the first electrical connector 203 allows for the electrical communication between the speaker module 100, the audio driver 102 therein, and the set of headphones 200. Generally this electrical communication is for carrying two channels of audio signals and providing them individually to the first electrical connector 203 of the receivers 201 so that they can be provided to the speaker modules 100. This arrangement facilitates quick and easy substitution of the speaker module 100 with an alternative speaker module 100 by a user. In a highly preferred embodiment, the front wall 202B includes a plurality of cutouts 209 (see FIG. 1) for facilitating the transfer of sound from the sound module 100 to the user.

Figure 3A:
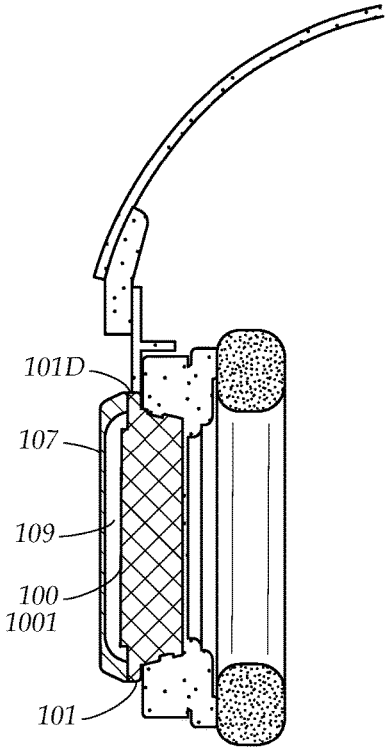
FIG. 3A is a front cross-sectional view of another alternative example embodiment of the speaker module and acoustical cavity according to the present invention.
Figure 3B:
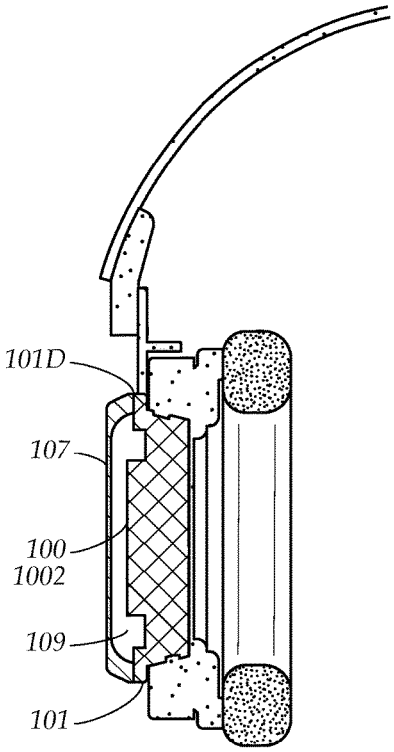
FIG. 3B is a front cross-sectional view of yet another alternative example embodiment of the speaker module and acoustical cavity according to the present invention.

Each speaker module 100 has a specific audio profile. That is, a particular conformation of the speaker module 100 will yield particular sound characteristics such as tone, pitch, frequency response, and intensity based on the type of audio driver 102. Accordingly, replacing the speaker module 100 with another speaker module having a different audio profile allows the user to quickly change the audio profile of the sound emitted by the set of headphones 200. Substituting the acoustical chamber shell 107, which is mated to the flange 101D, will further alter the sound characteristics of the headphones 200, as will be described in further detail hereinbelow. Referring to FIGS. 3A and 3B, the speaker module 100 is shown as two versions, namely a first speaker module 1001 and a second speaker module 1002. The audio profiles of the speaker modules 1001, 1002 are distinct due to the variance in the shape of the acoustical chamber 109, which is bounded by the speaker housing 101 and the acoustical chamber shell 107. The speaker modules 1001, 1002 may have a different shape from each other as shown, or may have the same shape and still have different audio profiles. The headband 205 preferably includes wires providing for the electrical communication between two or more of the at least one receiver 201.

Figure 2A:
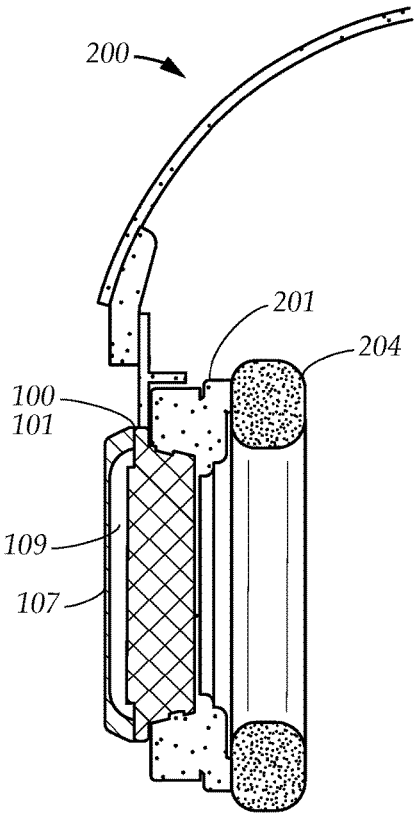
FIG. 2A is a cross-sectional view of an example embodiment of the speaker module and acoustical cavity according to the present invention.
Figure 2B:
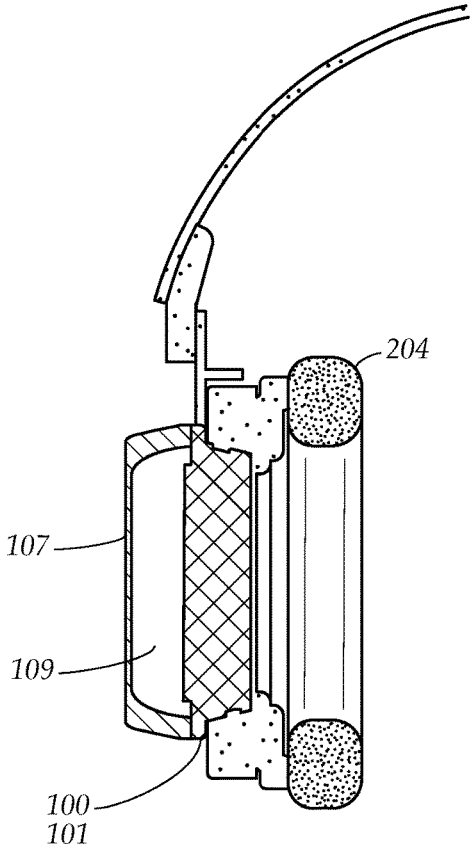
FIG. 2B is a cross-sectional view of an alternative example embodiment of the speaker module and acoustical cavity according to the present invention.

Referring to FIGS. 2A and 2B, two cross-sectional views show the speaker module 100 integrated into one of the receivers 201 of the headphones 200. Here, the set of headphones 200 is equipped with the earpad 204, providing a user with a comfortable fit while wearing the set of headphones 200. An acoustical chamber 109 is defined as the space between the speaker module 100 and the acoustical chamber shell 107. As can be seen between FIGS. 2A and 2B, the acoustical chamber 109 can take a wide variety of shapes and volumes, each affecting the audio profile of the integrated speaker module in different ways. Specifically, the size and shape of the acoustical chamber 109 is dictated by the acoustical chamber shell 107, and the speaker module 100, which together define the shape of the acoustical chamber 109. Additionally, the shape of the acoustical driver 102 (See FIG. 1) and/or the speaker housing 101 can also affect the size and shape of the acoustical chamber 109, as shown in FIGS. 3A and 3B. Of note here is the non-uniform shape of the embodiment of the speaker module 100 shown in FIG. 3B.

Figure 4:
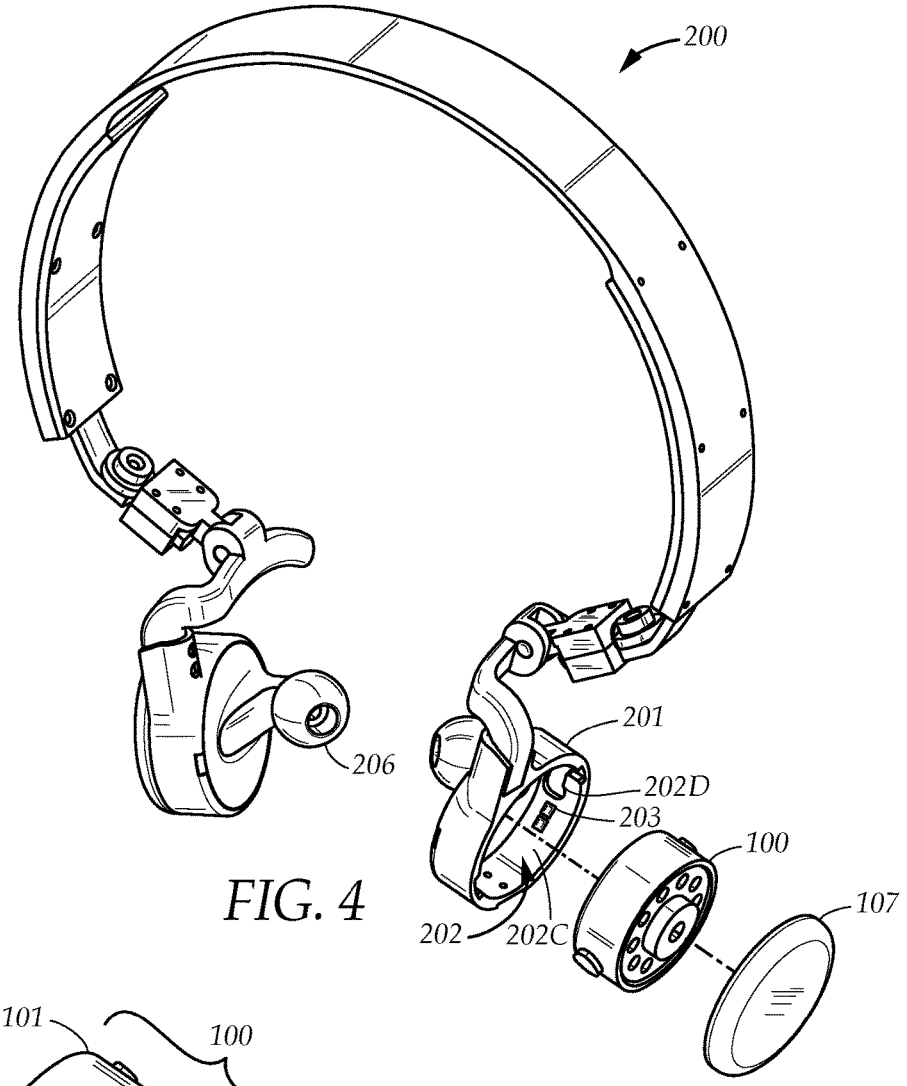
FIG. 4 is a diagrammatic perspective view of an alternative example embodiment of a set of headphones having earbuds with an integrated interchangeable speaker apparatus according to the present disclosure.
Figure 4A:
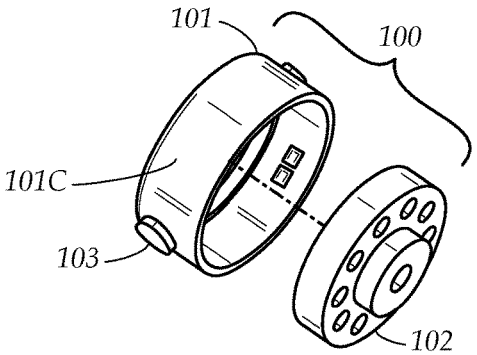
FIG. 4A is a diagrammatic perspective view of an alternative example embodiment of a speaker module according to the present disclosure.

FIGS. 4 and 4A show an alternative embodiment of the set of headphones 200. Specifically this embodiment of the set of headphones 200 features at least one earbud 206 having the at least one receiver 201. The receiver 201 in this embodiment of the set of headphones 200 also interfaces with the speaker module 100, and has the capability of quickly substituting the speaker module 100 to provide a variety of audio profiles of the sounds emitted by the set of headphones 200. Here, the at least one receiver 201 includes the cavity 202, the first electrical connector 203, the female attachment mechanism 202D, both of which are disposed on the sidewall 202C. After the speaker module 100 has been inserted into the cavity 202, the male attachment mechanism 103 is rotated to engage with the female attachment mechanism 202D. This secures the speaker module 100 until a user desires to change the sound characteristics of the set of headphones 200. As in the previously disclosed embodiments, the housing sidewall 101C has the second electrical connector for providing electronic communication between the audio driver 102 and the set of headphones 200. In some embodiments, the male attachment mechanism 103 and the female attachment mechanism 202D operate by providing a limited friction fit.

Figure 5:
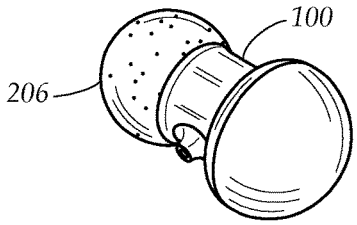
FIG. 5 a perspective view of an example embodiment of an earbud according to the present disclosure.
Figure 6:
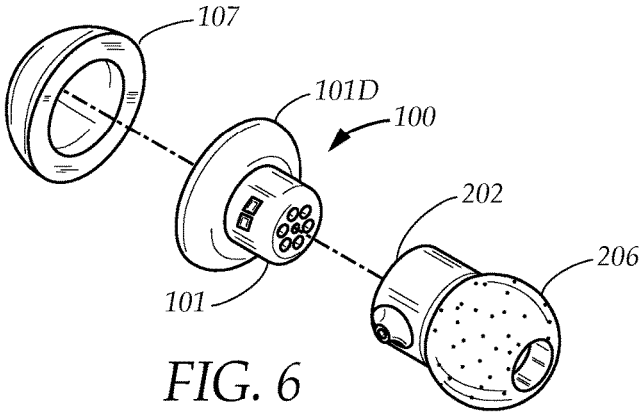
FIG. 6 is a diagrammatic perspective view of the example embodiment shown in FIG. 5.
Figure 6A:
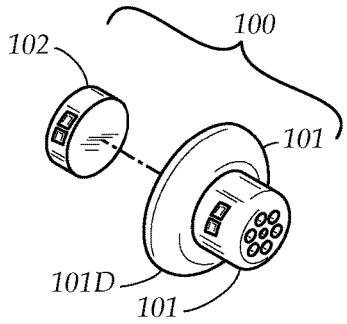
FIG. 6A is a diagrammatic perspective view of an alternative example embodiment of the speaker module of the present disclosure.

FIG. 5, FIG. 6 and FIG. 6A shows yet another embodiment of the interchangeable speaker assembly. Here, the speaker module 100 is connected to the earbud 206, and has a pronounced flange 101D. As can be seen in FIG. 6, this embodiment functions similarly to the previously disclosed embodiments. That is, this embodiment features the speaker module 100, which is inserted into the cavity 202 located on the earbud 206. The speaker module 100 also includes the acoustical chamber shell 107 which may be permanently or releasably attached to the flange 101D. FIG. 6A shows that in this embodiment the speaker module 100 includes the speaker housing 101 and the audio driver 102.

Figure 7:
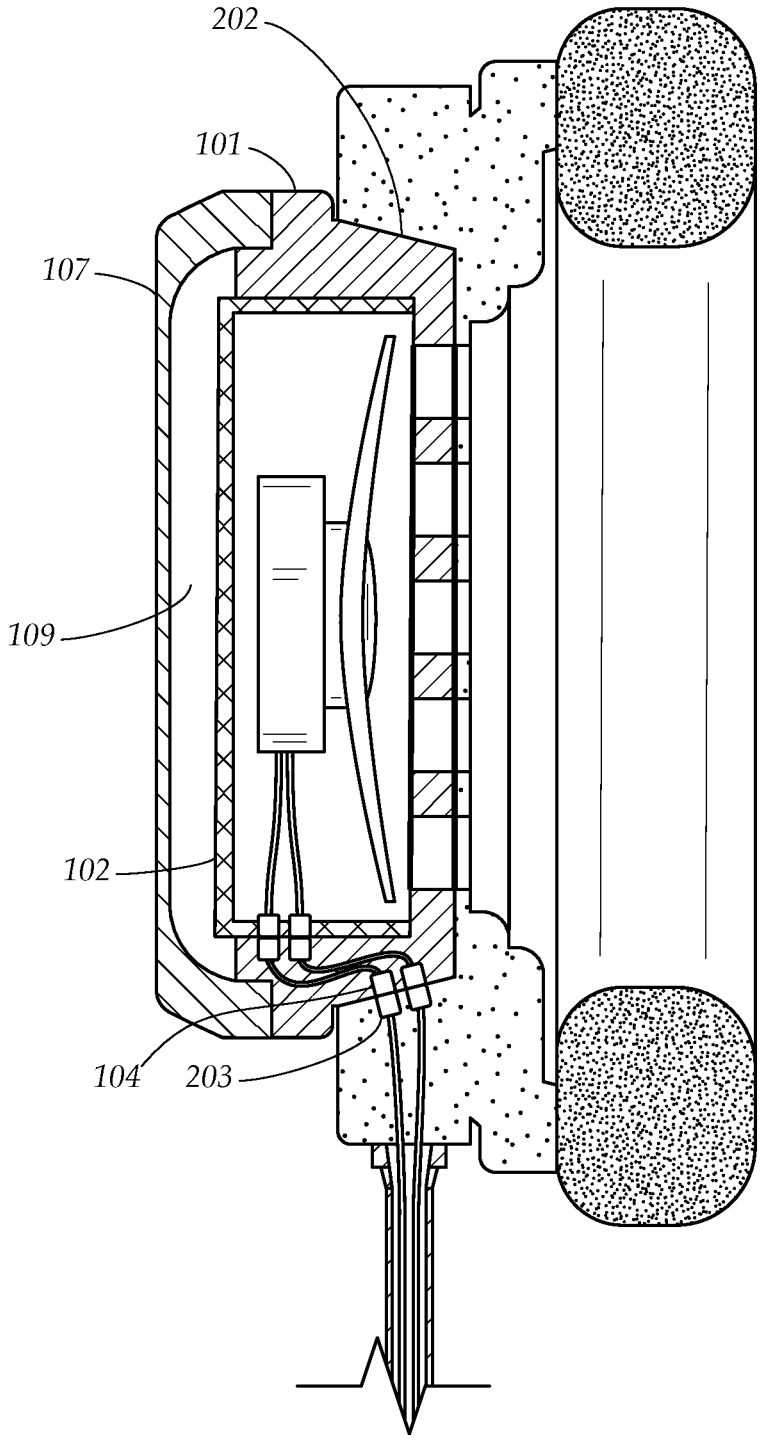
FIG. 7 is a cross-sectional front view of an example embodiment of the speaker assembly of the present disclosure, showing the internal electronics.

FIG. 7 is shows the electrical connection between the speaker module 100 and the set of headphones 200. Specifically, the speaker housing 101 includes the second electrical connector 104 in operative connection to the first electrical connector 203, disposed on the sidewall 202C of the cavity 202. This view also illustrates the position of the second electrical connector 104 and the first electrical connector 203 with regard to the acoustical chamber shell 107, the acoustical chamber 109, the audio driver 102, and the speaker housing 101. The interchangeable speaker assembly is configured so that the repeated removal and insertion of the speaker module 100 into the set of headphones 200 does not cause meaningful damage to the second electrical connector 104 or the first electrical connector 203.

Figure 8A:
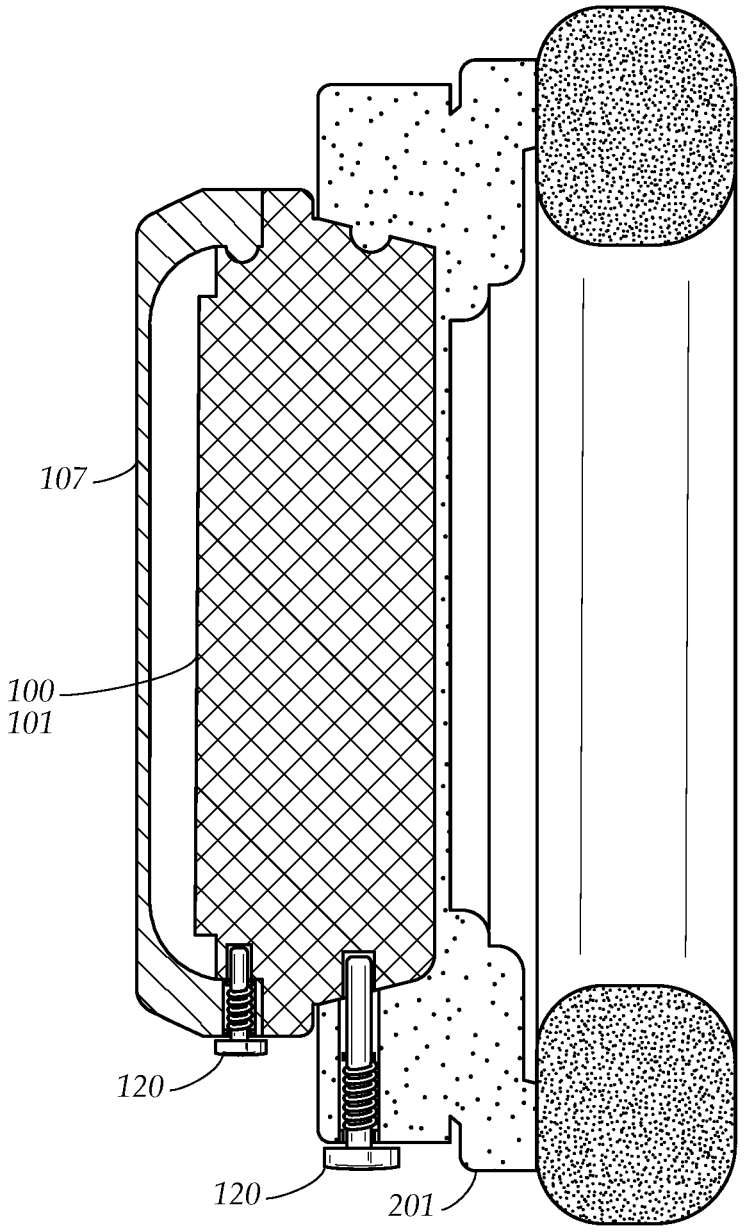
FIG. 8A is a cross-sectional front view of an example embodiment of the speaker assembly, highlighting one example of the attachment mechanism according to the present disclosure.
Figure 8B:
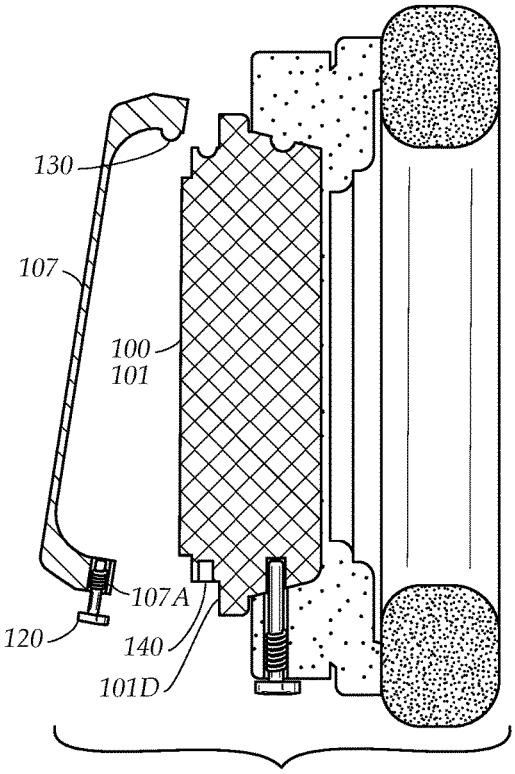
FIG. 8B is a cross-sectional view of an example embodiment of the speaker assembly according to the present disclosure, showing the detachable nature of the acoustical chamber shell of the present invention.
Figure 8C:
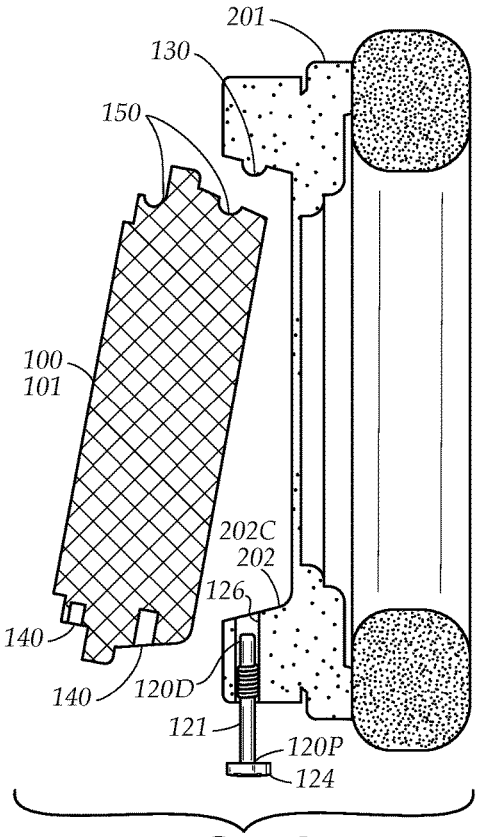
FIG. 8C is a cross-sectional front view of an example embodiment of the speaker housing according to the present invention, showing how the speaker housing integrates with the set of headphones according to the present disclosure.

Referring to FIGS. 8A, 8B, and 8C, another embodiment and configuration is illustrated that facilitates the selective attachment and detachment of the speaker housing 101, receiver 201, and acoustical chamber shell 107. In particular, in FIGS. 8A, 8B, and 8C, a distinct version of the male attachment mechanism 103 and the female attachment mechanism 202D shown in other drawing figures is depicted. The male attachment mechanism is provided in the form of spring pin assemblies 120 and retaining protrusions 130 on both the acoustical chamber shell 107 and the receiver 201. The female attachment mechanism is provided in the form of pin recesses 140 and notch receptacles 150 on the speaker module 100. Preferably the attachment of the speaker module 100 within the receiver 201 is accomplished by having one of the spring pin assemblies 102 on the receiver 201 selectively engaging one of the pin recesses 140 in the speaker module 100; and by having one of the retaining protrusions 130 on the receiver 201 selectively engaging one of the notch receptacles 150 in the speaker module 100. In this way, two male and four female attachment mechanisms work together to selectively secure the speaker module 100 within the receiver 201, wherein the speaker module 100 has four female attachment mechanisms and the receiver 201 has two male attachment mechanisms.

Each of the spring pin assemblies 120 includes a pin 121 having a proximal end 120P and a distal end 120D. A pin head 124 is located at the proximal end 120P. The pin 121 extends through a pin cavity 126. One of the spring pin assemblies 120 is located near the front edge 107A of the acoustical chamber shell 107, extending inwardly to engage one of the pin recesses 140 adjacent to the flange 101D of the speaker module 100. Another of the spring pin assemblies 120 is located in the receiver 201, extending toward the sidewall 202C of the cavity 202. The retaining protrusions 130 are preferably located fully opposite from the pin assemblies 120 on the acoustical chamber shell 107 and the receiver 201; and the notch receptacles 150 are preferably located fully opposite from the pin recesses 140 in the receiver 201.

Mating one of the speaker modules 100 to the receiver 201 by the user involves angling the speaker module 100 into the cavity 202 (as shown in FIG. 8C) to engage the notch receptacle 150 toward the front end 101A of that speaker module with the retaining protrusion 130 within the cavity 201 of the receiver 201; pivoting the speaker module 100 into the cavity so that it rests flat against the front wall 202B while extending the pin 121 proximally away from the cavity 201; and then releasing the pin 121 so that it extends into the pin recess 140 toward the front end 101A of the speaker module, thus locking the speaker module 100 in place (as shown in FIG. 8B) until it is desirable to remove it.

Mating one of the acoustical chamber shells 107 to the speaker module 100 involves angling the front edge 107A of the acoustical chamber shell 107 toward the flange 101D (as shown in FIG. 8B) to engage the notch receptacle 150 near the flange 101D of that speaker module with the retaining protrusion 130 on the acoustical chamber shell 107; pivoting the acoustical chamber shell 107 so that it rests flat against the flange 101D while extending the pin 121 of the acoustical chamber shell 107 proximally away from the speaker module 100; and then releasing the pin 121 so that it extends into the pin recess 140 near the flange 101D, thus temporarily locking the acoustical chamber shell 107 in place (as shown in FIG. 8A).

As discussed hereinabove, in accordance with the principles of the present disclosure, it is desirable to allow the user to quickly and easily remove and interchange the speaker module 100, such as after listening to the set of headphones and deciding to alter the sound characteristics of the set of headphones by employing a distinct speaker module 100 and/or acoustical chamber shell 107. Referring generally to FIGS. 8A, 8B, and 8C, removal of the acoustical chamber shell 107 is easily accomplished by simply engaging the pin head 124 of its associated pin assembly 120, pulling the pin 121 and pivoting the acoustical chamber shell 107 outwardly from the speaker module 100 to free the retaining protrusion 130 of that acoustical chamber shell 107 from its associated notch receptacle 150 on the speaker module 100. Removal of the speaker module 100 is similarly accomplished by engaging the pin head 124 of its associated pin assembly 120, pulling its pin 121 outwardly and pivoting the speaker module 100 outwardly from the cavity 202 to free the notch receptacle 150 of that speaker module 100 from the retaining protrusion 130 of the cavity 202.

In a preferred embodiment, a user uses the interchangeable speaker assembly according to the present disclosure by listening to a sound source played through the headphones until they desire the headphones to have different audio characteristics. From there, the user will operate the attachment mechanism as described above to remove the speaker module 100 from the set of headphones 200. The user will then select a second speaker module 100 with a different audio profile, and will then insert the second speaker module 100 into the set of headphones 200 and will secure said second speaker module 100 via the attachment mechanism 101D. Alternatively, a user may substitute the acoustical chamber shell 107 while retaining the speaker housing 101 to adjust the audio profile by giving the acoustical chamber 109 a different shape.

In a highly preferred embodiment, a user will customize the auditory output of the set of headphones through use of at least two interchangeable speaker assemblies, each with a unique audio profile. A user begins this customization by first inserting one of the interchangeable speaker assemblies into the receiver of the set of headphones such that said interchangeable speaker assembly is in electronic communication with the set of headphones. From there, a user will listen to the sounds emitted by the interchangeable speaker assembly via the set of headphones. If a user desires to further customize the sound emitted, the user will then remove the interchangeable speaker assembly from the set of headphones by engaging the attachment mechanism. In a preferred embodiment the attachment mechanism includes a spring pin, which is pulled to release the interchangeable speaker assembly from the set of headphones. When the interchangeable speaker assembly has been removed, a user will then select a second interchangeable speaker assembly with a different audio profile. This is achieved by utilizing a different speaker module, a different acoustical chamber shell, or some combination thereof. From there, a user will listen to the interchangeable speaker assembly via the set of headphones to hear emitted sounds with different sound characteristics. In some embodiments, the interchangeable speaker assembly is attached to the set of headphones by rotating the interchangeable speaker assembly into a secured position after inserting it into the cavity of the receiver of the set of headphones.

In some embodiments, a user may change the sound characteristics of the interchangeable speaker assembly by replacing the acoustical chamber shell, as opposed to the entire interchangeable speaker assembly. This may be done with the interchangeable speaker assembly inserted into the set of headphones or when the interchangeable speaker assembly has been removed from the set of headphones.

In another preferred embodiment, there is a kit in accordance with the present disclosure. The kit preferably includes the set of headphones 200 and a plurality of speaker modules 100, each of the speaker modules 100 having a unique sound profile. The user can, at their own discretion, then substitute the plurality speaker modules 100 for each other to have the set of headphones 200 create a different audio profile or produce sound with alternative sound characteristics.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an interchangeable speaker assembly. The disclosure is illustrated by example in the drawing figures, and throughout the written description. It should be understood that numerous variations are possible, while adhering to the inventive concept. Such variations are contemplated as being a part of the present disclosure.

What is claimed is:

1. An interchangeable speaker assembly for allowing a user to customize at least one sound characteristic of a set of headphones, the set of headphones having headphone wiring and at least one receiver having a front area and a back area, the back area having a cavity, the cavity having a rear opening for receiving the interchangeable speaker assembly, a sound permeable front wall for providing sound from the interchangeable speaker assembly to a user, and a sidewall extending between the front wall and the rear opening, the sidewall being shaped to accommodate the interchangeable speaker assembly and having a first electrical connector and at least one female attachment mechanism, the interchangeable speaker assembly comprising:

a speaker module having a speaker housing and an audio driver, the speaker housing having a front end, a rear end, a wall, and a flange disposed on the rear end, the front end having a smaller circumference than the rear end, the wall extending from the front end to the rear end, the wall having an interior surface, an exterior surface having at least one male attachment mechanism and a second electrical connector which corresponds to the first electrical connector;

an acoustical chamber shell having a circular main portion and a downwardly extending lip, the acoustical chamber shell being selectively mated to the flange; and an acoustical chamber, bounded by the rear end of the speaker module and the acoustical chamber shell.

2. The interchangeable speaker assembly of claim 1, wherein when the interchangeable speaker assembly is within the cavity of the receiver, there is electrical communication between the interchangeable speaker assembly and the headphone wiring.

3. The interchangeable speaker assembly of claim 2, the set of headphones comprising two receivers and a headband having a left end and a right end, the left end having one of the receivers, the right end having the other receiver, the headband including wiring providing for electrical communication between the two receivers.

4. The interchangeable speaker assembly of claim 3, the front wall having a plurality of cutouts.

5. The interchangeable speaker assembly of claim 4, the exterior surface of the wall of the speaker housing of the speaker module having two male attachment mechanisms comprising a spring pin assembly and a retaining protrusion, and the sidewall of the cavity of the receivers having two female attachment mechanisms comprising a pin recess and a notch receptacle.

6. The interchangeable speaker assembly of claim 4, wherein the at least one male attachment mechanism provides for a limited friction fit with the female attachment mechanism.

7. The interchangeable speaker assembly of claim 4, having one male attachment mechanism comprising a spring pin assembly and having one female attachment mechanism having a pin recess.

8. The interchangeable speaker assembly of claim 5, wherein the acoustical chamber shell has a spring pin assembly.

9. The interchangeable speaker assembly of claim 5, the acoustical chamber shell further comprising its own male attachment mechanism, the speaker housing further comprising an additional female attachment mechanism, wherein the acoustical chamber shell is mated to the speaker housing by the male attachment mechanism of the acoustical chamber shell interfacing with said female attachment mechanism of the speaker module.

10. The interchangeable speaker assembly of claim 9, the male attachment mechanism of the acoustical chamber shell comprising a spring pin assembly and the female attachment mechanism comprising a notch receptacle.

11. The interchangeable speaker assembly of claim 10, further comprising at least one additional interchangeable speaker assembly, each interchangeable speaker assembly having a unique audio profile.

12. A method of customizing the auditory output of a set of headphones through use of a first interchangeable speaker assembly and a second interchangeable speaker assembly, each interchangeable speaker assembly being for allowing a user to customize at least one sound characteristic of a set of headphones, the set of headphones having at least one receiver having a front area and a back area, the back area having a cavity, the cavity having a rear opening for receiving the interchangeable speaker assembly, a front opening for providing sound from the interchangeable speaker assembly to a user, and a sidewall extending between the front opening and the rear opening, the sidewall being shaped to accommodate the interchangeable speaker assembly and having a first electrical connector and at least one female attachment mechanism, the interchangeable speaker assembly comprising a speaker module having a speaker housing and an audio driver, the speaker housing having a front end, a rear end, a wall, and a flange mated to the rear end, the front end having a smaller circumference than the rear end, the wall extending from the front end to the rear end, the wall having an interior surface, an exterior surface having at least one male attachment mechanism and a second electrical connector which corresponds to the first electrical connector, an acoustical chamber shell having a circular main portion and a downwardly extending lip, the acoustical chamber shell being mated to the flange, and an acoustical chamber, bounded by the rear end of the speaker module and the acoustical chamber shell, comprising the steps of:

inserting, by a user, the first interchangeable speaker assembly into the cavity such that said first interchangeable speaker assembly is in electronic communication with the set of headphones;

listening, by the user, to at least one sound characteristic emitted by the set of headphones;

removing, by the user, the interchangeable speaker assembly from the cavity by disengaging the attachment mechanism;

selecting, by the user, the second interchangeable speaker assembly having an alternative audio profile;

inserting, by the user, the second interchangeable speaker assembly into the cavity such that said second interchangeable speaker assembly is in electronic communication with the set of headphones;

listening, by the user, to at least one alternate sound characteristic emitted by the set of headphones.

13. The method of claim 12, wherein the step of inserting, by a user, a first interchangeable speaker assembly into the cavity such that said first interchangeable speaker assembly is in electronic communication with the set of headphones is preceded by the step of removing the acoustical chamber shell from the flange; and the step of listening, by a user, to the alternative characteristic of one or more sounds emitted by the set of headphones is followed by the step of attaching, an acoustical chamber shell to the flange.

14. The method of claim 13, the step of inserting, by a user, a first interchangeable speaker assembly into the cavity such that said first interchangeable speaker assembly is in electronic communication with the set of headphones further comprising inserting one male attachment mechanism into one female attachment mechanism, and then inserting a second male attachment mechanism into a second female attachment mechanism.

15. The method of claim 13, the step of inserting, by a user, a first interchangeable speaker assembly into the cavity such that said first interchangeable speaker assembly is in electronic communication with the set of headphones further comprising inserting the interchangeable speaker assembly into the cavity to create a limited friction fit between the cavity and the interchangeable speaker assembly.

16. A kit for providing a customizable personal sound system comprising:

a set of headphones comprising two receivers and a headband having a left end and a right end, the left end having one of the receivers, the right end having the other receiver, the headband including wiring providing for electrical communication between the two receivers, each receiver having a front area and a back area, the back area having a cavity, the cavity having a rear opening for receiving the interchangeable speaker assembly, a front opening for providing sound from the interchangeable speaker assembly to a user, and a sidewall extending between the front opening and the rear opening, the sidewall being shaped to accommodate the interchangeable speaker assembly and having a first electrical connector and at least one female attachment mechanism;

a plurality interchangeable speaker assemblies for allowing a user to customize at least one sound characteristic of the set of headphones, each of the interchangeable speaker assemblies comprising:

a speaker module having a speaker housing and an audio driver, the speaker housing having a front end, a rear end, a wall, and a flange mated to the rear end, the front end having a smaller circumference than the rear end, the wall extending from the front end to the rear end, the wall having an interior surface, an exterior surface having at least one male attachment mechanism and a second electrical connector which corresponds to the first electrical connector;

an acoustical chamber shell having a circular main portion and a downwardly extending lip, the acoustical chamber shell being mated to the flange; and an acoustical chamber, bounded by the rear end of the speaker module and the acoustical chamber shell.

17. The kit of claim 16, wherein the acoustical chamber shell is mated to the speaker module by a male attachment mechanism on the acoustical chamber shell and a female attachment mechanism near the flange of the speaker module.

18. The kit of claim 16, the male attachment mechanism comprising a spring pin assembly and the female attachment mechanism comprising a notch receptacle.

* * * * *